US009951608B2

(12) United States Patent
Hudson

(10) Patent No.: US 9,951,608 B2
(45) Date of Patent: Apr. 24, 2018

(54) DOWNHOLE STRUCTURE SECTIONS

(71) Applicant: EXPRO NORTH SEA LIMITED, Reading, Berkshire (GB)

(72) Inventor: Steven Martin Hudson, Sturminster Newton (GB)

(73) Assignee: Expro North Sea Limited, Dyce (GB)

( * ) Notice: Subject to any disclaimer, the term of this patent is extended or adjusted under 35 U.S.C. 154(b) by 109 days.

(21) Appl. No.: 14/356,818

(22) PCT Filed: Oct. 19, 2012

(86) PCT No.: PCT/GB2012/000802

§ 371 (c)(1),
(2) Date: May 7, 2014

(87) PCT Pub. No.: WO2013/068709

PCT Pub. Date: May 16, 2013

(65) Prior Publication Data

US 2014/0320301 A1 Oct. 30, 2014

(30) Foreign Application Priority Data

Nov. 11, 2011 (GB) ..... 1119572.4

(51) Int. Cl.

| | |
|---|---|
| ***E21B 47/13*** | (2012.01) |
| ***E21B 47/12*** | (2012.01) |
| ***E21B 17/00*** | (2006.01) |
| ***E21B 41/00*** | (2006.01) |
| *E21B 17/02* | (2006.01) |

(52) U.S. Cl.

CPC ..... *E21B 47/12* (2013.01); *E21B 17/003* (2013.01); *E21B 41/0042* (2013.01); *E21B 47/122* (2013.01); *E21B 17/028* (2013.01)

(58) Field of Classification Search

CPC ..... E21B 47/122
USPC ..... 367/82; 340/853.7, 853.1, 854.4, 854.6
See application file for complete search history.

(56) References Cited

U.S. PATENT DOCUMENTS

| | | | | |
|---|---|---|---|---|
| 3,518,608 | A | 6/1970 | Papadopoulos | |
| 3,876,471 | A * | 4/1975 | Jones | E21B 17/00 175/320 |
| 4,015,234 | A * | 3/1977 | Krebs | E21B 41/0085 367/81 |
| 2002/0017905 | A1* | 2/2002 | Conti | G01V 3/28 324/339 |
| 2003/0042016 | A1* | 3/2003 | Vinegar | E21B 47/06 166/66 |

(Continued)

FOREIGN PATENT DOCUMENTS

| | | | |
|---|---|---|---|
| EP | 1748151 | A1 | 1/2007 |
| WO | 93/26115 | A2 | 12/1993 |

OTHER PUBLICATIONS

International Search Report (PCT/ISA/210) and Written Opinion (PCT/ISA/237) for corresponding PCT International Application No. PCT/GB2012/000802 filed Oct. 19, 2012, completed on Nov. 18, 2013 and dated Dec. 11, 2013.

*Primary Examiner* — Benyam Haile

(57) ABSTRACT

A lateral bore communication system where data signals are transmitted across the break in conductive path between a main bore and a lateral bore using a downhole structure section which has an electrode provided around a tubing portion and separated therefrom by an insulating layer.

14 Claims, 4 Drawing Sheets

(56) References Cited

U.S. PATENT DOCUMENTS

| | | | | |
|---|---|---|---|---|
| 2007/0034374 | A1* | 2/2007 | Gerez | E21B 47/09 166/255.1 |
| 2010/0101772 | A1* | 4/2010 | Lovell | E21B 47/121 166/50 |
| 2010/0181067 | A1* | 7/2010 | Chen | E21B 47/12 166/253.1 |
| 2011/0309836 | A1* | 12/2011 | Bittar | G01V 3/26 324/339 |
| 2013/0265171 | A1* | 10/2013 | Hay | E21B 17/003 340/854.4 |

* cited by examiner

DOWNHOLE STRUCTURE SECTIONS

BACKGROUND OF THE INVENTION

This application is a national stage of PCT International Application No. PCT/GB2012/000802 filed Oct. 19, 2012, published as WO2013/068709 A2 on May 16, 2013, which claims priority to GB 1119572.4 filed Nov. 11, 2011, the entire disclosures of which are incorporated herein by reference.

1. TECHNICAL FIELD

This invention relates to downhole structure sections as well as downhole structure arrangements, well installations, and communication systems including downhole structure sections.

Downhole structure comprises various types of tubular metallic structure such as casing, liner, and production tubing (production tubing is sometimes referred to simply as tubing). This invention relates to downhole structure sections including a portion of such tubular metallic structure.

2. BACKGROUND INFORMATION

In some existing communication systems, for example some of those supplied commercially by the applicant, the downhole metallic structure itself is used as a signal channel, Most often all of the metallic structure provided downhole will come into contact with one another at various points such that it tends to all reach the same potential at any one location (or depth) within the well. Thus in most practical situations it is not possible to use different portions of the metallic structure as a signal channel and a return. Thus earth is generally used as a return in such systems. In a typical case an isolation joint is provided between two sections of the downhole structure such that one is electrically insulated from the other. It then becomes possible to transmit and/or pick up electrical signals and/or power across the isolation joint. Other than providing an isolation joint in the structure, it is difficult to provide a contact which can allow the provision of an earth return.

However providing isolation joints in downhole structure is undesirable as it introduces a potential weak point in the structure and engineering isolation joints to avoid this pitfall is relatively complex and expensive.

It is also desirable to be able to generate power locally downhole.

SUMMARY OF THE DISCLOSURE

The present invention is aimed at providing downhole structure sections which are useful in addressing some of these issues.

According to a first aspect of the present invention there is provided a downhole structure section comprising a tubular metallic portion and a sleeve-like electrode portion provided around the outer surface of the tubular metallic portion and exposed for electrical contact with the surroundings, the electrode portion being insulated from the tubular metallic portion by insulation means provided between the tubular metallic portion and the electrode portion.

This allows the provision of a large electrode in the confined spaces found downhole in a practical and convenient way.

Most typically the tubular metallic portion will be a liner portion and the downhole structure section a downhole liner section.

The electrode may be arranged as a cathodic protection, and/or a sacrificial anode. The electrode may be arranged as part of a communications system.

The electrode may be of copper—typical for genera) use. The electrode may be of other metals and may for example be of aluminium when the electrode is for use as a sacrificial anode. The electrode may be of a material that is different from the material of the tubular metallic portion. The electrode may be of a material that has a different standard electrode potential than the material of the tubular metallic portion.

The downhole structure section may comprise an electrical module having one terminal connected to the electrode. The electrical module may have another terminal connected to, or arranged for connection to, one of the tubular metallic portion and metallic structure adjacent to and electrically continuous with the tubular metallic portion.

In one set of embodiments, the electrode comprises a sacrificial anode and the electrical module is arranged for harvesting electrical energy generated as the sacrificial anode corrodes. The electrical module may comprise at least one charge storage means for storing the electrical energy generated.

In another set of embodiments, the electrical module comprises at least one of a receiver and a transmitter and the electrode is used in the reception and/or transmission of electrical signals and/or electrical power at the electrical module. In yet further embodiments the electrode may be used in power generation and in signalling.

The downhole structure section may comprise two electrode portions, which may be spaced axially on the tubular metallic portion. One of the electrode portions may be of a first material and the other electrode portion may be of a second material. The first material may be more electrochemically active than the second material. For example the first material might be aluminium or magnesium and the second material might be copper or platinised titanium. The currently preferred practical combination would be a aluminium electrode and a platinised titanium electrode.

One of the electrode portions may comprise a sacrificial anode and the electrical module may be connected between the two electrodes to harvest electrical energy generated as the sacrificial anode corrodes.

In another set of embodiments the electrode, or at least one of the electrodes is used both in the generation of power and in the reception and/or transmission of electrical signals and/or electrical power.

The insulation means may be sandwiched between the electrode and the tubular metallic portion.

The insulation means may comprise a ceramic layer plasma coated onto the tubular metallic portion.

The sleeve-like electrode portion may comprise a metallic layer plasma coated onto the ceramic layer.

In an alternative, the insulation means may comprise a coating, such as paint, applied to the metallic tubing portion and/or spacing o-rings.

The electrode may have an axial length of say 5 meters. In general terms the axial length of the electrode will be greater, normally much greater, than the diameter of the tubular metallic portion.

The tubular metallic portion may comprise a constriction portion having at least an external constriction in diameter to accommodate the electrode and/or electrical module. This can remove or at least reduce any increase in overall diameter of the section. The constriction portion may have an internal constriction in diameter.

The electrical module may comprise a switch for selectively connecting the electrode to one of the tubular metallic portion and metallic structure adjacent to and electrically continuous with the tubular metallic portion and a control means for controlling said switch, the electrode being of a material having a different standard electrode potential than said one of the tubular metallic portion and metallic structure such that when the switch connects the electrode to said one of the tubular metallic portion and metallic structure a galvanic current is caused to flow in the metallic structure and the electrical module may be arranged to encode data onto the metallic structure by using the control means to operate the switch to control the galvanic current in dependence on the data to be sent.

The downhole structure section may be a flow line section.

According to another aspect of the present invention there is provided a downhole structure arrangement comprising a downhole structure section according to the first aspect of the invention and at least one further length of tubular metallic structure which is adjacent to and electrically continuous with the tubular metallic portion of the downhole structure section.

According to a further aspect of the present invention there is provided a downhole communication system comprising a downhole structure section according to the first aspect of the invention, a metallic structure which comprises the tubular metallic portion of the downhole structure section, and a communications unit remote from the downhole structure section, wherein the communications unit comprises at least one of a receiver arranged for receiving electrical signals from, and a transmitter arranged for applying electrical signals to, the metallic structure at a location which is remote from the downhole structure section, the downhole structure section comprises an electrical module having one terminal connected to the electrode and another terminal connected to the metallic structure at a location which is remote from the communications unit, and the electrical module comprises at least one of a receiver arranged for receiving electrical signals from, and a transmitter arranged for applying electrical signals to, the metallic structure.

According to yet another aspect of the present invention there is provided a downhole lateral bore communication system comprising a downhole structure section as defined above located in a lateral bore, a main bore communications unit located outside of the lateral bore and arranged for applying signals to metallic structure in a main bore such that the signals propagate into the surroundings and/or receiving signals from the surroundings via metallic structure in the main bore, and a lateral bore communications unit located in the lateral bore, the lateral bore communications unit being arranged to receive signals picked up from the surroundings by the electrode of the downhole structure section and/or for applying signals to the surroundings via the electrode of the downhole structure section, such that signals can be communicated between the lateral bore communications unit and the main bore communications unit.

According to yet another aspect of the present invention there is provided a downhole lateral bore power transmission system comprising a downhole structure section as defined above located in a lateral bore, a main bore power transmission unit located outside of the lateral bore and arranged for applying power signals to a metallic structure in a main bore, such that the signals propagate into the surroundings and a lateral bore receiving unit located in the lateral bore, the lateral bore receiving unit being arranged to receive power signals picked up from the surroundings by the electrode of the downhole structure section such that power can be communicated to the lateral bore receiving unit from the main bore power transmission unit.

According to a further aspect of the invention there is provided a method of downhole lateral bore communications for communications between a main bore and a lateral bore in which a downhole structure section as defined above is located in the lateral bore the method comprising applying signals to metallic structure in the main bore such that the signals propagate into the surroundings and using the electrode of the downhole structure section to pick up signals from the surroundings.

According to yet a further aspect of the invention there is provided a method of downhole lateral bore communications for communications between a main bore and a lateral bore in which a downhole structure section as defined above is located in a lateral bore, the method comprising applying signals to the electrode of the downhole structure section such that the signals propagate into the surroundings and using metallic structure in the main bore to pick up signals from the surroundings.

The downhole structure section may be located adjacent a location where the lateral bore meets the main bore. The tubular metallic portion of the downhole structure section may be the last such portion in the lateral bore—i.e. the portion nearest to the main bore.

According to yet a further aspect of the present invention there is provided a downhole power transmission system comprising a downhole structure section according to the first aspect of the invention, a metallic structure which comprises the tubular metallic portion of the downhole structure section, and a power transmission unit remote from the downhole structure section, wherein the power transmission unit comprises a transmitter arranged for applying electrical power signals to the metallic structure at a location which is remote from the downhole structure section, the downhole structure section comprises an electrical module having one terminal connected to the electrode and another terminal connected to the metallic structure at a location which is remote from the power transmission unit, and the electrical module comprises a receiver arranged for receiving electrical power signals from the metallic structure.

Each of the above arrangements may be used in a producing well, for example to aid in the taking and transmission of pressure and temperature measurements and/or controlling or operating a downhole device and also may be used during drilling of a well for example as part of a measurement whilst drilling (MWD) system.

According to yet a further aspect of the present invention there is provided a well installation comprising one of: a downhole structure section as defined above, a downhole structure arrangement as defined above, a downhole communication system as defined above, and a downhole power transmission system as defined above.

The well installation may comprise a main bore and a lateral bore and the downhole structure section may be provided in the lateral bore and may be at a location towards the start of the lateral bore. At such a location the bores are relatively close to one another and the electrode can particularly facilitate communication between the bores.

BRIEF DESCRIPTION OF THE DRAWINGS

Embodiments of the present invention will now be described, by way of example only, with reference to the accompanying drawings, in which.

DETAILED DESCRIPTION

Figure 1:
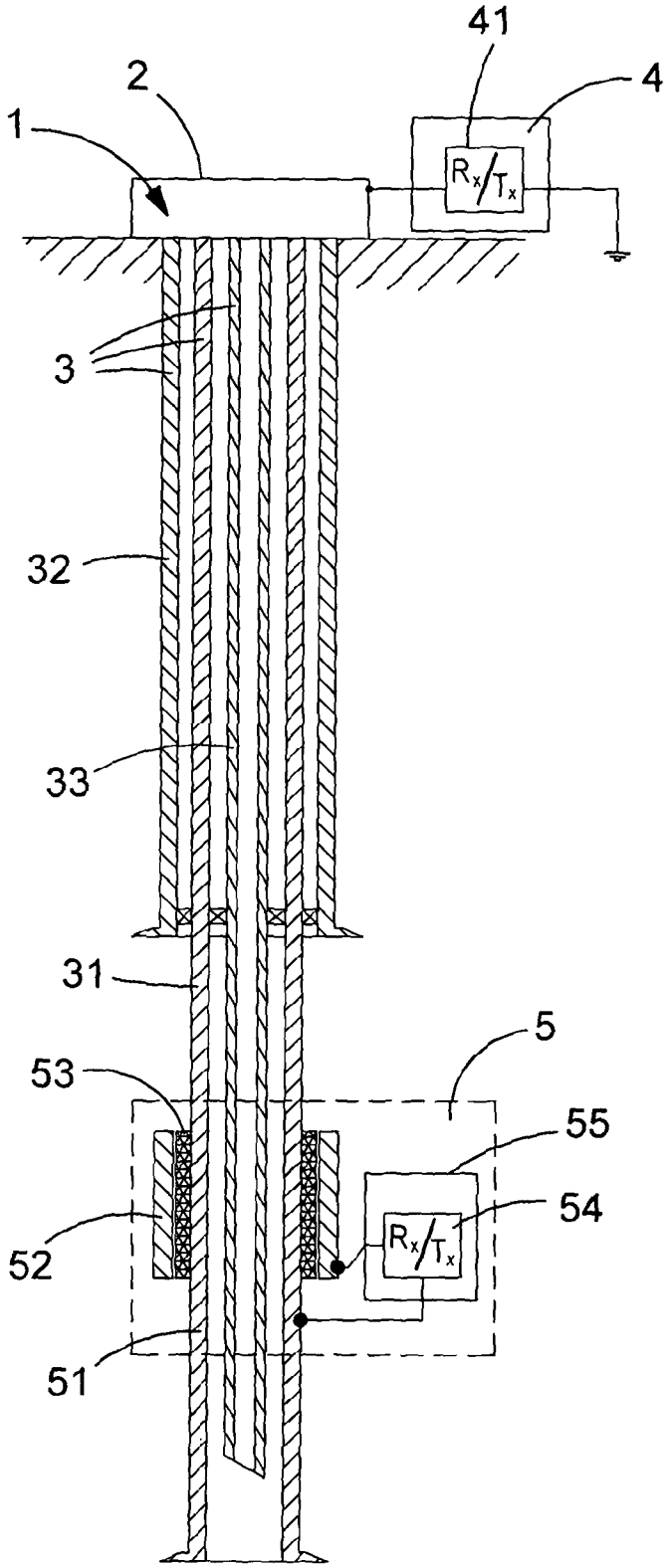
FIG. 1 schematically shows a well installation including a downhole communication system which itself comprises a downhole structure section.

FIG. 1 shows a well installation which comprises a metallic structure 1 including a well head 2 and downhole structure 3. The downhole structure 3 comprises liner 31, casing 32 and production tubing 33. The well installation comprises a downhole communication system including a surface unit 4 and a downhole structure section 5. The downhole structure section 5 is shown in highly schematic form in FIG. 1. This downhole structure section 5 is completion conveyed. That is to say when the liner 31 of the downhole structure 3 is inserted into the well installation during completion, the downhole structure section 5 is included in this liner. Indeed the downhole structure section 5 comprises a tubular metallic portion 51 which makes up part of the liner 31.

As well as the tubular metallic portion 51, the downhole section 5 comprises a metallic sleeve-like electrode 52 which is provided around the outside curved surface of the tubular metallic portion 51 and thus is in the form of an annular band. In the present embodiment this electrode 52 is of copper whilst the tubular portion is of steel. Sandwiched between the sleeve-like electrode 52 and the tubular portion 51 is an insulation layer 53. Again this insulation layer is in the form of an annular band. In the present embodiment the insulation layer is a ceramic coating. In the present embodiment both the ceramic insulation layer 53 and copper electrode 52 are plasma coated onto the tubular metallic portion 51 and both have an axial length of approximately 5 meters. A typical minimum length for the electrode 52 might be 1 meter.

It should be noted that in alternative embodiments, the electrode 52 and insulation 53 may be provided in different forms. For example, the surface of the tubular portion 51 may be coated in, for example, paint and o-ring spacers may be provided between this painted surface and the electrode provided in such an arrangement.

The downhole structure section 5 also comprises an electrical signal transceiver 54 which is part of a larger electrical module 55. The electrical signal transceiver 54 has one terminal connected to the electrode 52 and one terminal connected to the metallic structure 1. In this instance this second terminal of the electrical transceiver 54 is connected to the tubular metallic portion 51 of the structure section 5. However in other implementations the connection may be made to another portion of the metallic structure. In particular such a connection might be made to a portion of the liner 31 which is adjacent to and electrically continuous with the tubular metallic portion 51 of the downhole structure section 5.

Note that as shown in FIG. 1, the downhole structure section 5 is placed in a position in the liner beyond the casing 32 provided within the well. Furthermore the outer surface of the electrode 52 is exposed. This means that the electrode 52 may make contact with the surroundings. Thus the electrode 52 provides a connection to earth which allows the electrical transceiver 54 to apply signals to the liner 31 and hence metallic structure 1 as a whole and also to pick up signals from the liner 31.

Note that whilst in this embodiment, the well installation is a producing well and the downhole structure section 5 forms part of the liner 31, in other implementations the well may be one which is being drilled and in such a case the structure section 5 could be conveyed along with the drill string and the tubular metallic portion 51 could be part of the drill string. Alternatively the downhole structure might be provided as part of the production tubing. In general terms to be useful the downhole structure section needs to be provided on a portion of tubular downhole structure that is in contact with the surroundings so that the electrode 52 can contact with the surroundings.

The surface unit 4 comprises an electrical transceiver 41 which has one terminal connected to the well head 2 and another terminal connected to ground. Thus this electrical transceiver 41 can also apply signals to the metallic structure 1 and pick up signals from the metallic structure 1. This means that signals may be transmitted between the surface unit 4 and the downhole tubing section 5. Thus communications may be achieved between the surface and the downhole location using the same principals of electrical communication described in the Applicant's earlier patent applications such as WO 93/26115.

Note that whilst in the present embodiment the surface unit 4 has an electrical transceiver 41 which is connected between the well head 2 and earth, it is also possible to use other systems such as inductive systems including a toroid provided around the downhole structure, near the well head, for injecting signals into the downhole metallic structure and extracting such signals. Further, rather than a single downhole structure section 5 being used to communicate with a different type of surface unit, in other implementations two or more downhole structure sections 5 of the type shown in FIG. 1 may be provided along the length of the downhole structure and communication may be carried out between those structure sections 5.

Figure 2:
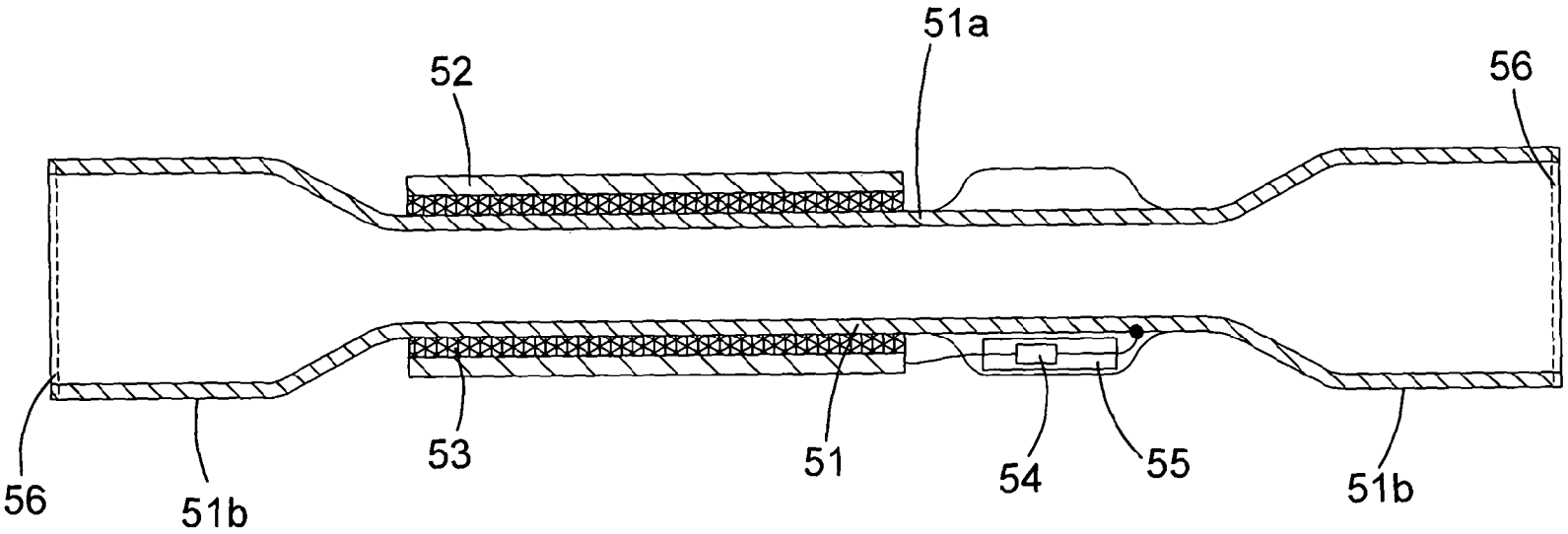
FIG. 2 shows a downhole structure section of the well installation shown in FIG. 1.

FIG. 2 shows the downhole structure section 5 of the embodiment shown in FIG. 1 in a slightly less schematic form. Here again the tubular metallic portion 51, the electrode 52, and insulating layer 53 can be seen. Further the electrical transceiver unit 54 is shown as part of the larger electrical module 55 which is fitted as part of a mandrel tool around the tubular metallic portion 51. This module 55 will typically include sensors such as pressure and temperature sensors for taking readings in the region of the downhole structure section 5 as well as the appropriate control electronics. Similarly the module 55 may be arranged to control other devices based on signals from the surface. Further as generally indicated at 56 in FIG. 2, the tubular metallic portion 51 terminates in appropriate threaded portions 56 for connection to the preceding and following sections of the liner 31. Note that the tubular metallic portion 51 includes a constriction. Thus there is a middle portion 51*a* with smaller external (and in this case also smaller internal) diameter and two end portions 51*b* having larger external (and in this case also larger internal) diameter. This structure can allow connection of the downhole structure section 5 into other tubular structure (liner 31 in this embodiment) of a particular size without the overall diameter of the structure section being greater than the adjacent tubular structure.

Whilst the above example has been described in terms of a communication system where data signals can be transmitted between the surface unit 4 and the downhole structure section 5, in other implementations the same type of principles may be used in transmitting power from the surface down to the structure section 5, in particular to the electrical module 55 of the structure section. In such a case, the same general arrangement of tubular metallic portion 51, insulating layer 53 and electrode 52 will be used, but power signals will be applied at the surface and the electrical module 55 will be arranged for harvesting the electrical power seen between the electrode 52 and the tubing portion 51. The electrical module might also comprise charge storage means, such as one or more cells, or super capacitors, for storing the energy so received.

In a further different implementation, the electrode 52 may be arranged as a sacrificial anode and, for example, be of aluminium. In such a case, as the aluminium corroded then, as is well understood, current would be generated which on the one hand would help protect the metallic tubing 3 against corrosion due to cathodic protection effects but on the other hand would generate a source of electrical energy which could be harvested and used and/or stored in the electrical module 55. Thus, in a version of the downhole tubing section where the electrode 52 is arranged as a sacrificial anode, the downhole tubing section may be used as a power source for powering either other components provided within the tubing section itself or other local tools/devices.

Figure 3:
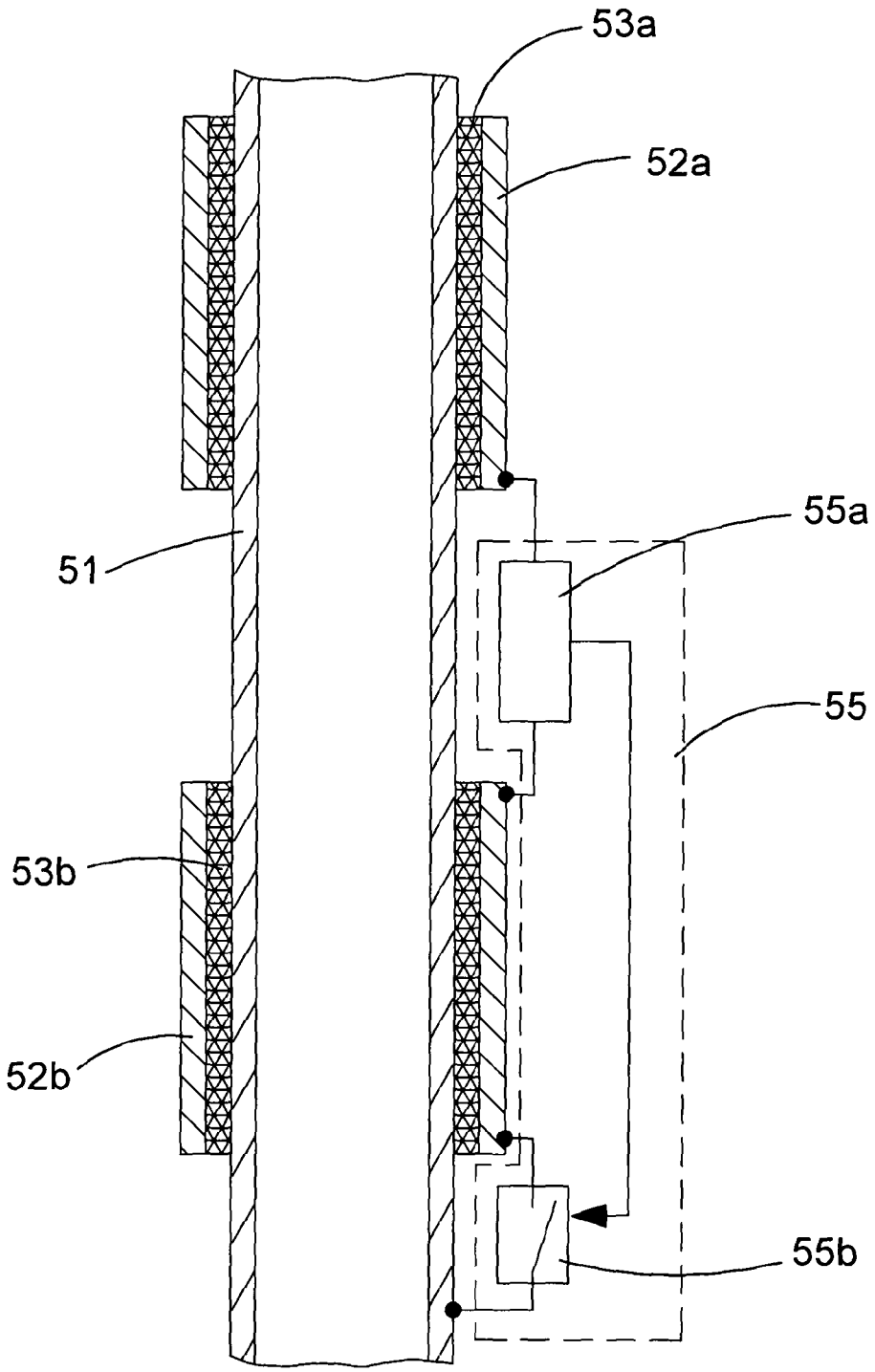
FIG. 3 shows part of an alternative downhole structure section.

FIG. 3 shows part of an alternative downhole structure section which has similarities to the downhole structure section shown in FIGS. 1 and 2. Again the downhole structure section comprises a tubular metallic portion 51 which, as in the case of the embodiment described above, can be connected to other metallic tubular portions to form, for example, a liner within a well. Again there is an electrical module 55. However, in the present embodiment there are two metallic sleeve like electrodes 52*a* and 52*b* with associated insulating layers 53*a* and 53*b* and the electrical module 55 has a different structure than in the downhole structure section of FIGS. 1 and 2. In the present downhole structure section, the first electrode 52*a* is of different material than the second electrode 52*b*. In particular the two materials have different electrochemical activity or to put this another way a different standard electrode potential from one another. Thus the first electrode 52*a* may be of, for example, copper or platinised titanium whereas the second electrode 52*b* may be of aluminium or perhaps magnesium. The currently preferred combination is to have the first electrode 52*a* being of platinised titanium and the second electrode 52*b* being of aluminium.

As in the situations described above, the downhole structure section of FIG. 3 is designed to be exposed to the surroundings when downhole in a well. As such in effect an electrochemical cell can be set up. Due to the different standard electrode potentials (or activity/reactivity) of the electrodes, there will be a potential difference between the two electrodes 52*a* and 52*b* and a galvanic current flowing which can be harvested and/or used. The second electrode will be depleted over time as the system is used.

The electrical module 55 in the present embodiment comprises a main unit 55*a* and a switch 55*b*. The main unit 55*a* has terminals connected to the first electrode 52*a* and the second electrode 52*b* such that the main unit 55*a* can harvest the electricity generated due to the galvanic effects and use this to power its own operation and/or for storage and/or for powering other components.

The main unit 55*a* may also include an electrical transceiver of the same type included in the downhole section shown in FIG. 2 which is arranged for transmitting and/or receiving signals by virtue of being connected between the metallic structure and the first electrode 52*a*.

However, in the present embodiment a different communication technique is used. In the present case the switch 55*b* (which might be implemented mechanically, electromechanically, or electronically) is provided for selectively connecting the second electrode 52*b* to the tubular metallic portion 51. In the present case, as is almost always going to be the case for practical considerations, the tubular metallic portion 51 is made of steel. Thus again because the second electrode 52*b* is of a relatively reactive metal, there will be a significant potential difference between the electrode 52 and the tubular metallic portion 51. To put this another way, when the switch 55*b* is closed to connect the second electrode 52*b* to the tubular metallic portion 51, a galvanic current will flow. Further this will propagate away from the downhole structure section through the metallic structure of the well installation in which the downhole structure section is installed such that this current may be detected at a remote location.

Hence by controlling the operation of the switch 55*b*, i.e. opening and closing it, it is possible to encode data to be transmitted away from the downhole structure section. Thus, for example, the main unit 55*a* may take a pressure or temperature reading and transmit this away from the downhole structure section by operating the switch on and off in order to encode data onto the galvanically generated signals which propagate away from the downhole structure section. Put more generally, in this embodiment the downhole structure section is arranged to apply a galvanically generated current to the metallic structure and to vary or modulate this current in order to transmit data.

Note that whilst the downhole structure section shown in FIG. 3 includes both two electrodes and an electrical module arranged to allow communication using variation of a galvanic current applied the metallic structure, it is not necessary to include both of these features together. Either may be used independently of the other.

Figure 4:
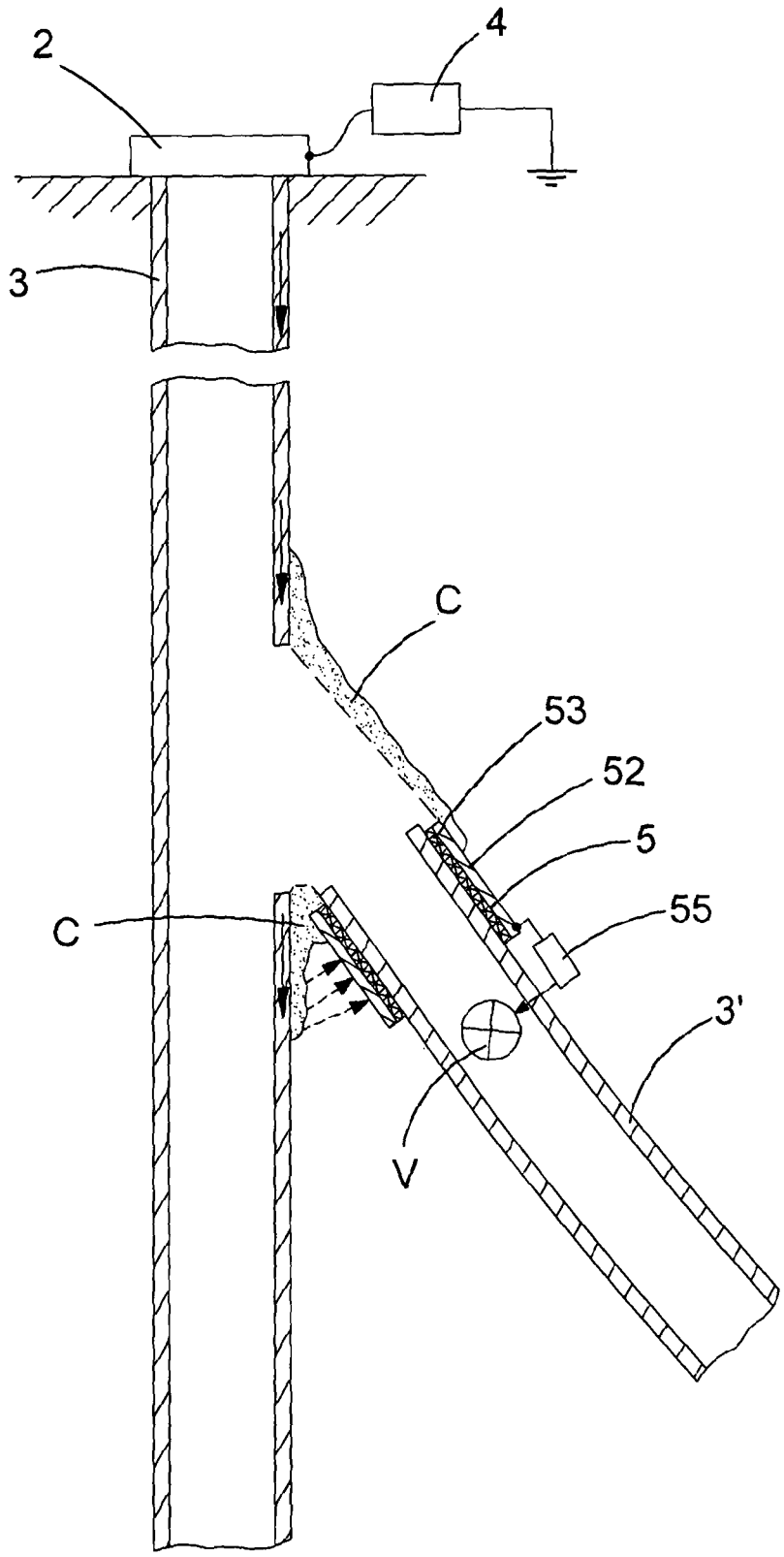
FIG. 4 schematically shows a well installation including a lateral bore communication system which includes a downhole structure section.

FIG. 4 shows an alternative well installation including a lateral bore communication system. The well installation comprise a well head 2, main bore downhole metallic structure 3, and a surface unit 4 having one terminal connected to the well head 2 and another terminal connected to earth. The surface unit 4 is arranged for applying electrical signals to the well head which propagate along the downhole metallic structure 3 in a main bore of the well such that these may be picked up by suitable downhole units.

The well installation also includes lateral bore downhole metallic structure 3' located in a lateral bore. As a matter of practicality this lateral bore downhole metallic structure 3' will not be in direct metal to metal electrical contact with the metallic structure 3 in the main bore. Rather, in the region where the lateral bore meets the main bore, cement C will be provided to ensure that there is a continuous and sealed flow path between the lateral bore and main bore. However, there will be a gap between the lateral bore metallic structure 3 and the main bore metallic structure 3 with the cement bridging this gap.

In the present embodiment, a downhole structure section 5 of the type shown in FIG. 2 or 3 is provided in the lateral bore. In particular, in the present embodiment, the tubular metallic portion 51 of the downhole structure section 5 is the last such piece of structure provided in the lateral bore i.e. that closest to the main bore. Thus the electrode 52 of the downhole structure section 5 is located in the surroundings in a region adjacent to the main bore. This means that the electrode is particularly well placed to pick up signals propagating through those surroundings due to signals present in the downhole metallic structure 3 in the main bore. Thus in particular, the electrode 52 may be used to pick up signals applied to the main bore metallic structure 3 by the surface unit 4. This provides a mechanism by which electrical signals may be transmitted from the main bore into the lateral bore, and in particular, between the metallic structure in the main bore and the metallic structure or components in the lateral bore.

In the present embodiment the electrical module 55 of the downhole structure section 5 provided in the lateral bore is connected directly to a valve V and arranged to control operation of the valve V in dependence on signals transmitted from the surface unit 4.

Of course in other alternatives, the electrical module 55 may be arranged to apply signals to the metallic structure 3' in the lateral bore for onward transmission. These may just be the signals as received at the electrode or the electrical module may be arranged to receive and then retransmit the signals as an active relay station. Similarly the electrical module could be arranged to apply signals to the surroundings via the electrode 52 for transmission into the main bore for receipt at the surface unit 4 or elsewhere in the main bore. There can be two way communication if required.

It will be clear that either the downhole structure section as shown in FIG. 2 or the downhole structure section as shown in FIG. 3 could be used in a well installation of the type shown in FIG. 4.

In at least some implementations, particularly one such as shown in FIG. 4 which includes picking up power in a lateral bore, more power may be required at certain times than can be directly collected. Thus storage means may be provided. For example to operate the valve of FIG. 4 in a timely fashion or to overcome 'stiction' then more power may be required than immediately available from the electrode arrangement. An electrical storage means may be provided at or in the region of downhole structure section 5 which can be 'trickle' charged from the electrode and can provide the higher power when required to operate the valve. In one example the available electrical charging power may be in the region of 0.5 W and the power required for operation of a device 100 W.

The invention claimed is:

1. A downhole lateral bore communication system comprising:

a downhole structure section located in a lateral bore, the downhole structure section comprising a lateral bore communications unit located in the lateral bore; and a main bore communications unit located at an uphole location and arranged to:

apply electrical data carrying signals to an electrically continuous main bore tubular metallic structure at the uphole location, the electrically continuous main bore tubular metallic structure comprising a plurality of electrically continuous tubular metallic portions in a main bore for communication of those data carrying signals from the uphole location using the electrically continuous main bore tubular metallic structure as a signal channel such that the signals propagate along the main bore tubular metallic structure from the uphole location to a downhole location proximate to the lateral bore, and then from the electrically continuous main bore tubular metallic structure into the surroundings for receipt at the lateral bore communications unit located in the lateral bore, and/or receive electrical data carrying signals at the uphole location from the electrically continuous main bore tubular metallic structure, those signals having been communicated to the electrically continuous main bore tubular metallic structure via the surroundings from the lateral bore communication unit; and wherein the downhole structure section, which comprises the lateral bore communications unit, comprises a tubular metallic portion and a sleeve-like electrode portion provided around the outer surface of the tubular metallic portion that is exposed for electrical contact with the surroundings, the electrode portion being insulated from the tubular metallic portion by an insulator provided between the tubular metallic portion and the electrode portion; and further wherein the lateral bore communications unit is arranged to:

receive electrical data carrying signals picked up from the surroundings by the electrode of the downhole structure section; and/or apply electrical data carrying signals to the surroundings via the electrode of the downhole structure section;

such that signals can be communicated between the lateral bore communications unit located in the lateral bore and the main bore communications unit located at an uphole location via the surroundings and the electrically continuous main bore tubular metallic structure.

2. The downhole lateral bore communication system according to claim 1 in which the downhole structure section comprises two electrode portions with one of the electrode portions being of a first material and the other electrode portion being of a second, different, material.

3. The downhole lateral bore communication system according to claim 2 in which the standard electrode potential of the first material is different from the standard electrode potential of the second material.

4. The downhole lateral bore communication system according to claim 2 in which one of the electrode portions comprises a sacrificial anode and an electrical module is connected between the two electrodes to harvest electrical energy generated as the sacrificial anode corrodes.

5. The downhole lateral bore communication system according claim 1 in which the electrode of the downhole structure section is arranged as a sacrificial anode.

6. The downhole lateral bore communication system according to claim 5 in which the lateral bore communications unit is arranged for harvesting electrical energy generated as the sacrificial anode corrodes.

7. The downhole lateral bore communication system according to claim 6 in which the lateral bore communications unit comprises at least one charge storage device for storing the electrical energy generated.

8. The downhole lateral bore communication system according to claim 1 in which the electrode is used both in the generation of power and in the reception and/or transmission of electrical signals and/or electrical power.

9. The downhole lateral bore communication system according to claim 1 in which the lateral bore communications unit comprises a switch for selectively connecting the electrode to one of the tubular metallic portion of the downhole structure section and lateral bore tubular metallic structure adjacent to and electrically continuous with the tubular metallic portion and a controller for controlling said switch, the electrode being of a material having a different standard electrode potential than said one of the tubular metallic portion and lateral bore tubular metallic structure such that when the switch connects the electrode to said one of the tubular metallic portion and lateral bore tubular metallic structure a galvanic current is caused to flow in the lateral bore tubular metallic structure and the lateral bore communications unit being arranged to encode data onto the lateral bore tubular metallic structure by using the control means to operate the switch to control the galvanic current.

10. The downhole lateral bore communication system according to claim 1 in which the insulator of the downhole structure section is sandwiched between the electrode and the tubular metallic portion.

11. The downhole lateral bore communication system according to claim 1 in which the insulator of the downhole structure section comprises a ceramic layer plasma coated onto the tubing portion.

12. The downhole lateral bore communication system according to claim 11 in which the sleeve-like electrode portion comprises a metallic layer plasma coated onto the ceramic layer.

13. A method of downhole lateral bore communications for communications between a main bore and a lateral bore in which a downhole structure section is located, the downhole structure section comprising a tubular metallic portion and a sleeve-like electrode portion provided around the outer surface of the tubular metallic portion and exposed for electrical contact with the surroundings, the electrode portion being insulated from the tubular metallic portion by insulation provided between the tubular metallic portion and the electrode portion and the method comprising:

applying electrical data carrying signals to an electrically continuous main bore tubular metallic structure at an uphole location, the electrically continuous main bore tubular metallic structure comprising a plurality of electrically continuous tubular metallic portions in the main bore for communication of those data carrying signals from the uphole location using the electrically continuous main bore tubular metallic structure as a signal channel such that the signals propagate along the electrically continuous main bore tubular metallic structure from the uphole location to a downhole location proximate the lateral bore, and then from the electrically continuous main bore tubular metallic structure into the surroundings, and using the electrode of the downhole structure section to pick up signals from the surroundings having been communicated to the surroundings from the electrically continuous main bore tubular metallic structure in the main bore, and/or applying electrical data carrying signals to the electrode of the downhole structure section such that the signals propagate into the surroundings and then to the electrically continuous main bore tubular metallic structure in the main bore, and using the electrically continuous main bore tubular metallic structure in the main bore to pick up signals from the surroundings, and to communicate those signals to an uphole location.

14. The downhole lateral bore communication system according to claim 3 in which one of the electrode portions comprises a sacrificial anode and an electrical module is connected between the two electrodes to harvest electrical energy generated as the sacrificial anode corrodes.

* * * * *